US006558027B2

(12) United States Patent
Ellis et al.

(10) Patent No.: US 6,558,027 B2
(45) Date of Patent: May 6, 2003

(54) ILLUMINATED SEAT BELT BUCKLE

(75) Inventors: Robert P. Ellis, Metamora, MI (US); Franklin L. Kiiskila, Leonard, MI (US); Edgar H. Schlaps, Washington, MI (US)

(73) Assignee: TRW Vehicle Safety Systems Inc., Lyndhurst, OH (US)

( * ) Notice: Subject to any disclaimer, the term of this patent is extended or adjusted under 35 U.S.C. 154(b) by 5 days.

(21) Appl. No.: 09/798,529

(22) Filed: Mar. 2, 2001

(65) Prior Publication Data

US 2002/0122307 A1 Sep. 5, 2002

(51) Int. Cl.[7] ..... B60Q 3/00
(52) U.S. Cl. ..... 362/483; 362/84
(58) Field of Search ..... 362/84, 103, 253, 362/108, 483; 24/163 K, 633; 224/163

(56) References Cited

U.S. PATENT DOCUMENTS 4,928,366 A * 5/1990 Ballet ..... 24/636
5,181,773 A 1/1993 Colvin
5,438,492 A 8/1995 Collins et al.
5,892,436 A 4/1999 Blackburn et al.
6,098,252 A * 8/2000 Woerth, Jr. ..... 24/163 K

* cited by examiner

*Primary Examiner*—Y. My Quach-Lee
(74) *Attorney, Agent, or Firm*—Tarolli, Sundheim, Covell & Tummino L.L.P.

(57) ABSTRACT

A buckle (10) for a vehicle seat belt system (12) comprises a latch mechanism (26) for connection with a tongue assembly (14) of the seat belt system. The latch mechanism (26) has a latched condition and a released condition. The buckle (10) also comprises a manually engageable pushbutton (40) connected with the latch mechanism (26). The pushbutton (40) is movable between a first position in which the latch mechanism is in the latched condition and a second position in which the latch mechanism is in the released condition. The buckle (10) contains an illumination mechanism (46) comprising an electroluminescent panel (50) which may or may not be movable with the pushbutton when the pushbutton moves between the first and second positions.

12 Claims, 3 Drawing Sheets

ILLUMINATED SEAT BELT BUCKLE

BACKGROUND OF THE INVENTION

1. Technical Field

The present invention relates to an illuminated seat belt buckle for use in a seat belt system of a vehicle.

2. Description of the Prior Art

A seat belt system for helping to protect an occupant of a vehicle typically includes seat belt webbing, a tongue assembly on the webbing, and a buckle. The tongue assembly is inserted and locked in the buckle to secure the webbing about a vehicle occupant. Such a seat belt system may also include a mechanism for illuminating the buckle to help the vehicle occupant locate the buckle.

SUMMARY OF THE INVENTION

The present invention is a buckle for a vehicle seat belt system. The buckle comprises a latch mechanism for connection with a tongue assembly of the seat belt system. The latch mechanism has a latched condition and a released condition. The buckle also comprises a manually engageable pushbutton connected with the latch mechanism. The pushbutton is movable between a first position in which the latch mechanism is in the latched condition and a second position in which the latch mechanism is in the released condition. The pushbutton contains an illumination mechanism comprising an electroluminescent panel movable with the pushbutton when the pushbutton moves between the first and second positions.

BRIEF DESCRIPTION OF THE DRAWINGS

The foregoing and other features of the present invention will become apparent to one skilled in the art to which the present invention relates upon consideration of the following description of the invention with reference to the accompanying drawings, in which.

DESCRIPTION OF AN EMBODIMENT

Figure 1:
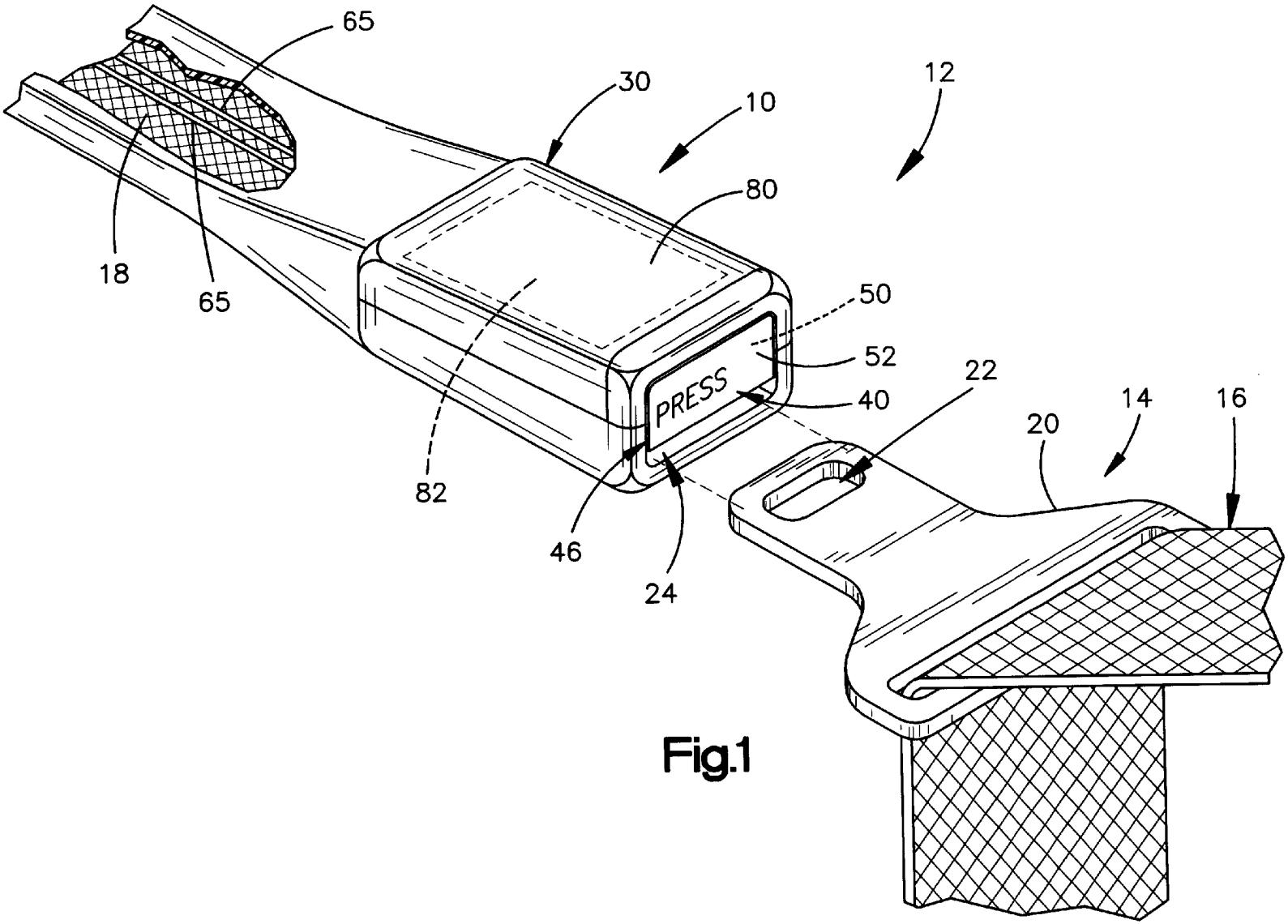
FIG. 1 is a perspective view of a vehicle occupant protection apparatus including a tongue assembly and a seat belt buckle in accordance with the present invention.

The present invention relates to an illuminated seat belt buckle for use in a vehicle. The present invention is applicable to various seat belt buckle configurations. As representative of the invention, FIG. 1 illustrates a seat belt buckle 10 that forms part of a vehicle occupant protection apparatus, or seat belt system, 12. The buckle 10 (described below in detail) is anchored in the vehicle in a known manner, such as by an anchor or length of belt webbing 18.

The seat belt system 12 includes a tongue assembly 14 that is supported on a length of belt webbing 16. The tongue assembly 14 includes a latch plate 20 having a latching opening 22.

Figure 2:
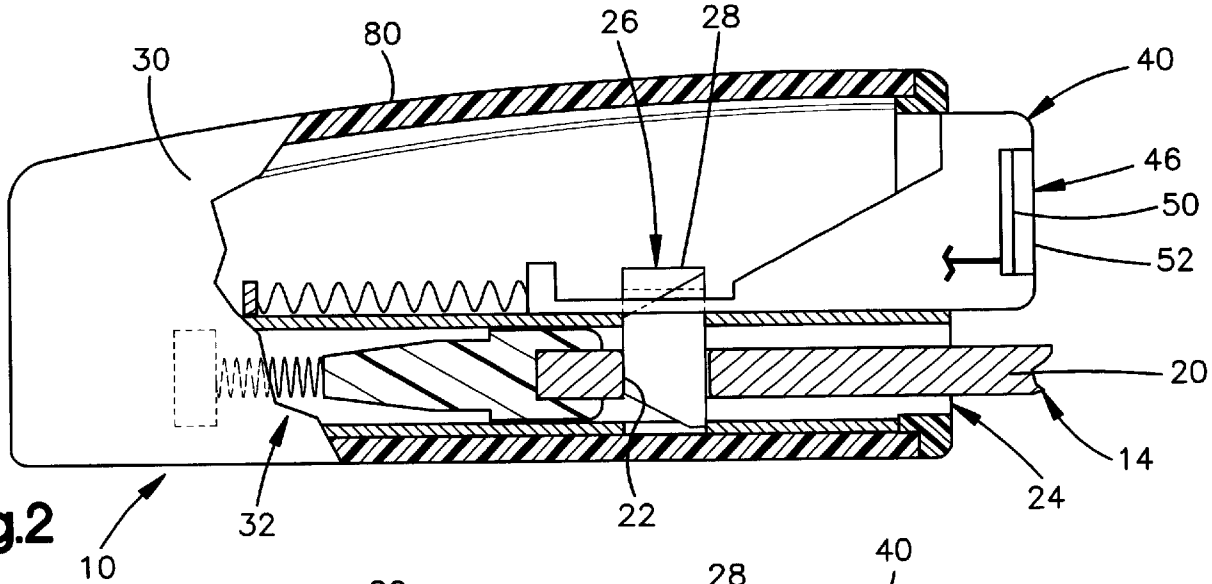
FIG. 2 is a side view, partly in section, of the buckle and a part of the tongue assembly, showing the buckle in a latched condition.
Figure 3:
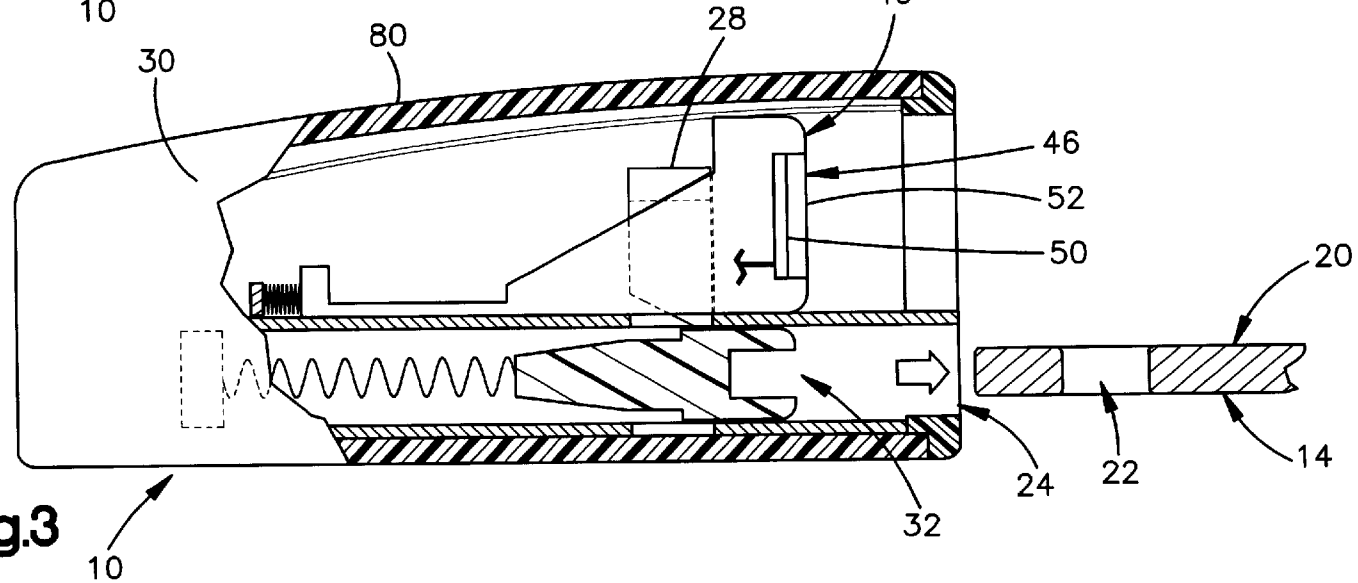
FIG. 3 is a view similar to FIG. 2 showing the buckle in a released condition.

The buckle 10 includes a housing 30. The housing 30 supports a pushbutton 40 for sliding movement in the housing 30 between a first position as shown in FIG. 2 and a second position as shown in FIG. 3.

Figure 5:
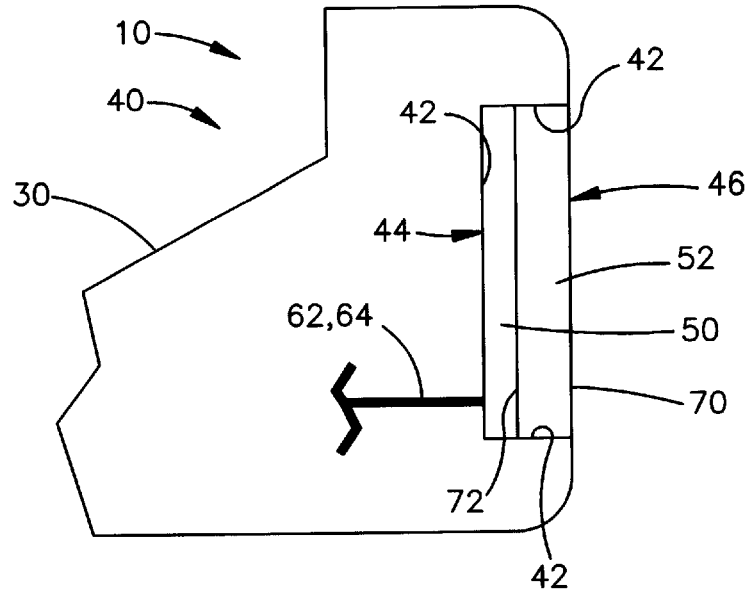

The pushbutton 40 has surfaces 42 (FIG. 5) that define a recess or chamber 44 in the pushbutton. The buckle 10 includes an illumination mechanism 46 located in the chamber 44, for illuminating a portion of the buckle. The illumination mechanism 46 includes an electroluminescent ("EL") panel 50 and a lens 52.

Figure 4:
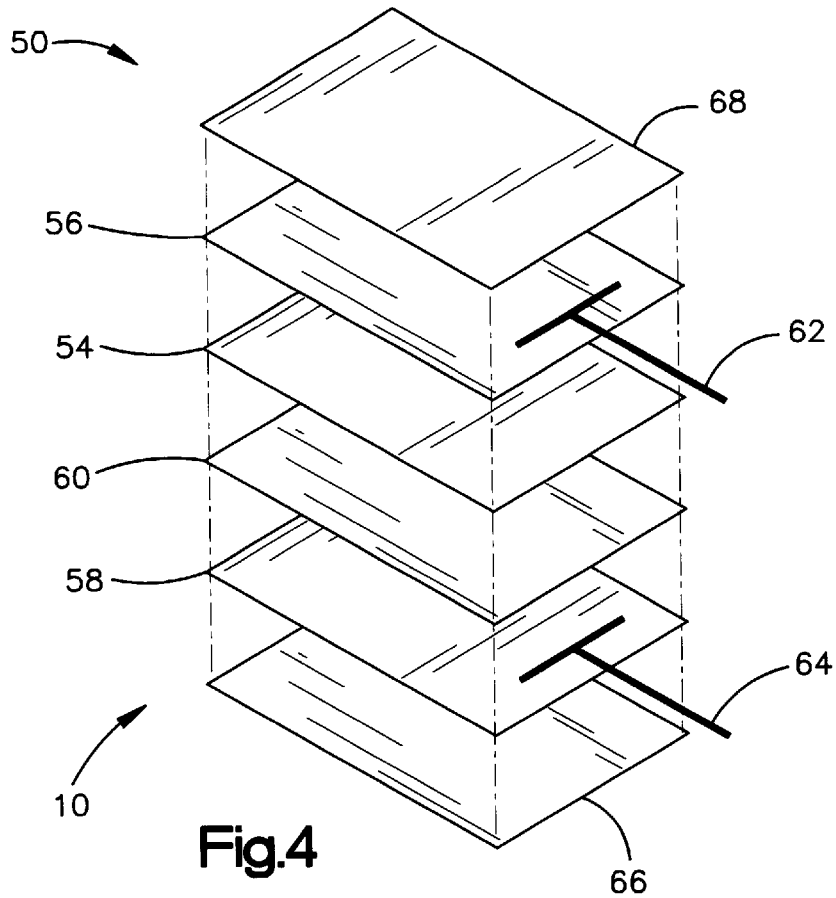
FIG. 4 is a schematic view of portions of an electroluminescent panel that forms part of the buckle of FIG. 1; and, FIG. 5 is an enlarged view of portions of the buckle of FIG. 1.

The EL panel 50, or EL lamp, is a film made of several functional sheets layered together. The EL lamp 50 may be made in several different manners. FIG. 4 illustrates in exploded form the structure of one type of EL lamp 50. Other types of EL lamps 50 that would function in the buckle 10 are available from manufacturers such as BKL Inc., of King of Prussia, Pa.

The EL lamp 50 (FIG. 4) includes a phosphor layer 54 sandwiched between a transparent or translucent front electrode 56 and a rear electrode 58. A dielectric layer 60 is disposed between the phosphor layer 54 and the rear electrode 58.

A front lead 62 is connected with the front electrode 56. A rear lead 64 is connected with the rear electrode 58. Lead wires 65 (FIG. 1) extend along the anchor 18 for carrying electric current to the leads 62 and 64 and, thereby, to the EL panel 50.

A rear plate 66 (FIG. 4) acts as a substrate and support for the electrodes 56 and 58 and the phosphor layer 54. A thin layer of a transparent or translucent polymer, such as polyester 68, overlies and protects the front electrode 56. Alternatively, the front electrode 56 may be formed by deposition of a thin conductive layer directly on the inner surface of the top layer 68 of the structure.

When an electric potential is applied between the electrodes 56 and 58, the phosphor layer 54 is excited and produces light. The light can illuminate the pushbutton 40 or other portion of the buckle 10. The lens 52 helps to protect the EL lamp 50 and to diffuse the light generated by the EL lamp.

The lens 52 (FIG. 5) is located at least partially in the chamber 44 in the pushbutton 40. The lens 52 covers and protects the EL lamp 50 and has an outer surface 70 that is manually engageable by an occupant of the vehicle to actuate the pushbutton 40. The lens 52 has an inner surface 72 that is presented toward the EL lamp 50.

The buckle 10 (FIGS. 1–3) has an insertion slot 24 for receiving the latch plate 20. The buckle 10 also includes a latch mechanism 26 (FIG. 2), including a movable latch member 28.

When the tongue assembly 14 is inserted into the buckle 10, the latch member 28 moves into the latching opening 22, as shown in FIG. 2, to lock the tongue assembly to the buckle. The latch mechanism 26 is in a latched condition, and the pushbutton 40 is in a first position.

To release the latch mechanism 26, a vehicle occupant manually engages the outer surface 70 of the lens 52. Force applied to the lens 52 is transmitted through the lens into the EL lamp 50 and into the other portions of the pushbutton 40. The pushbutton 40 moves from the first position to a second position, or released position, as shown in FIG. 3. The illumination mechanism 46 moves with the pushbutton 40 during movement of the pushbutton between the first and second positions.

As the pushbutton 40 moves from the first position to the second position, the latch member 28 is lifted out of the latch opening 22 in the tongue assembly 14. The tongue assembly 14 is released for movement relative to the buckle 10. An ejector mechanism 32 moves the tongue assembly 14 out of engagement with the buckle 10.

A typical EL lamp 50 that may be used on the face of a seat belt buckle pushbutton as shown in FIGS. 1–3 may have the following dimensions:

Thickness: 0.15 mm to 0.5 mm or more

Width: 20 mm to 100 mm or more

Height: 5 mm to 25 mm or more

The dimensions of the chamber 44 in the pushbutton 40 are selected to receive an EL panel 50, and lens 52, of the appropriate size. The dimensions can vary depending upon the size of the pushbutton and the buckle. The EL panel 50 can be sized to cover up to 90% or more of the exposed end surface area of the pushbutton 40.

The EL lamp 50 is easily formable to a non-planar contour, such as a non-planar contour of a portion of the buckle 10, an example of which is the non-planar portion of the buckle extending around the edge of the insertion slot 24 for the latch plate 20. The EL lamp 50 can be injection molded, insert molded, or otherwise assembled with other parts of the pushbutton. In addition, the EL lamp 50 can be fabricated in almost all colors, including white, and is extremely durable and vibration resistant. Also, the EL lamp 50 has no significant heat emission, exhibits little or no color change over the life of the product, consumes little electric power, and produces a uniform intensity of light over its surface. For these reasons, the EL lamp 50 is advantageous for use in illuminating a portion of a seat belt buckle 10.

From the above description of the invention, those skilled in the art will perceive improvements, changes and modifications in the invention. For example, the illumination mechanism 46 may be located in a portion of the buckle 10 other than the pushbutton 40. Thus, an illumination mechanism 46 may be located along the upper surface 80 of the buckle 10 as shown schematically at 82 in FIG. 1. Alternatively, the illumination mechanism 46 may be located around the edge of the pushbutton 40 to define visibly the pushbutton for an occupant, or around the edge of the insertion slot 24 for the latch plate 20 to define visibly the insertion slot. Also, the EL panel 50 or the lens 52 may be configured with a design, such as lettering, rather than being configured to glow in one solid uniform area. Such improvements, changes and modifications within the skill of the art are intended to be covered by the appended claims.

Having described the invention, we claim:

1. A buckle for a vehicle seat belt system, said buckle comprising:

a latch mechanism for connection with a tongue assembly of the seat belt system, said latch mechanism having a latched condition and a released condition; and a manually engageable pushbutton connected with said latch mechanism and movable between a first position in which said latch mechanism is in the latched condition and a second position in which said latch mechanism is in the released condition;

said pushbutton containing an illumination mechanism comprising an electroluminescent panel movable with said pushbutton when said pushbutton moves between the first and second positions.

2. A buckle as set forth in claim 1 wherein said electroluminescent panel comprises first and second electrode layers and an inner layer disposed between said electrode layers, said inner layer comprising an electroluminescent material that produces light when an electric potential is applied between said electrode layers.

3. A buckle as set forth in claim 2 wherein said illumination mechanism further comprises a lens covering said electroluminescent panel, said lens having an outer surface that forms an outer manually engageable surface of said pushbutton.

4. A buckle as set forth in claim 1 wherein said pushbutton has surfaces defining a chamber in said pushbutton, said electroluminescent panel being disposed in said chamber.

5. A buckle as set forth in claim 4 wherein said illumination mechanism further comprises a lens covering said electroluminescent panel and disposed at least partially in said chamber in said pushbutton, said lens having an outer surface that forms an outer manually engageable surface of said pushbutton.

6. A buckle as set forth in claim 1 wherein said electroluminescent panel covers up to about 90% or more of an exposed end surface area of said pushbutton.

7. A buckle as set forth in claim 1 wherein said electroluminescent panel has a non-planar configuration.

8. A buckle as set forth in claim 1 wherein said electroluminescent panel has a size in the range of from about 20 mm to about 100 mm wide and from about 5 mm to about 25 mm high.

9. A buckle for a vehicle seat belt system, said buckle comprising:

a latch mechanism for connection with a tongue assembly of the seat belt system, said latch mechanism having a latched condition and a released condition; and a manually engageable pushbutton connected with said latch mechanism and movable between a first position in which said latch mechanism is in the latched condition and a second position in which said latch mechanism is in the released condition;

said buckle containing an illumination mechanism comprising an electroluminescent panel for illuminating a portion of said buckle.

10. A buckle as set forth in claim 9 wherein said electroluminescent panel has a non-planar configuration.

11. A buckle as set forth in claim 9 wherein said electroluminescent panel is located on said pushbutton of said buckle.

12. A buckle as set forth in claim 9 wherein said electroluminescent panel comprises first and second electrode layers and an inner layer disposed between said electrode layers, said inner layer comprising an electroluminescent material that produces light when an electric potential is applied between said electrode layers.

* * * * *